US009565926B2

(12) United States Patent
Xi et al.

(10) Patent No.: US 9,565,926 B2
(45) Date of Patent: Feb. 14, 2017

(54) ORAL CARE IMPLEMENT

(71) Applicant: COLGATE-PALMOLIVE COMPANY, New York, NY (US)

(72) Inventors: Wenjin Xi, Shanghai (CN); Ting Yan, Jiangsu (CN); Yanmei Ji, Jiangsu (CN)

(73) Assignee: COLGATE-PALMOLIVE COMPANY, New York, NY (US)

( * ) Notice: Subject to any disclaimer, the term of this patent is extended or adjusted under 35 U.S.C. 154(b) by 378 days.

(21) Appl. No.: 14/348,922

(22) PCT Filed: Mar. 28, 2013

(86) PCT No.: PCT/CN2013/073298

§ 371 (c)(1),
(2) Date: Apr. 1, 2014

(87) PCT Pub. No.: WO2014/153747

PCT Pub. Date: Oct. 2, 2014

(65) Prior Publication Data

US 2016/0073769 A1 Mar. 17, 2016

(51) Int. Cl.
*A46B 5/02* (2006.01)
*B25G 1/10* (2006.01)

(52) U.S. Cl.
CPC ..... *A46B 5/026* (2013.01); *B25G 1/102* (2013.01); *A46B 2200/1066* (2013.01)

(58) Field of Classification Search
CPC ..... A46B 5/026; A46B 5/00; A46B 5/02; A46B 2200/1066; B25G 1/102
See application file for complete search history.

(56) References Cited

U.S. PATENT DOCUMENTS

| | | | |
|---|---|---|---|
| 4,763,375 | A | 8/1988 | Vieten |
| 5,054,154 | A | 10/1991 | Schiffer et al. |
| 5,908,038 | A | 6/1999 | Bennett |
| 6,101,659 | A | 8/2000 | Halm |

(Continued)

FOREIGN PATENT DOCUMENTS

| | | |
|---|---|---|
| CA | 2004029 | 5/1990 |
| CN | 100463623 | 8/2007 |

(Continued)

OTHER PUBLICATIONS

International Search Report and the Written Opinion issued in International Application PCT/CN2013/073298 mailed Jan. 9, 2014.

*Primary Examiner* — Shay Karls

(57) ABSTRACT

An oral care implement with a gripping portion. The oral care implement is a toothbrush (100) including an elongated body (101) formed of a first material and a handle (104) including a proximal gripping portion (114) and a distal neck portion (115) supporting a head (102) containing a plurality of tooth cleaning elements (108). A longitudinally elongated through slot (130) is formed in the gripping portion (114) of the handle (104) which extends transversely between front and rear exposed surfaces (112) of the handle (104). A second material which is elastomeric is disposed in the slot (130). A longitudinally elongated depression (120) having a transversely concave profile is formed in the rear exposed surfaces (112) of the handle (104) which communicates with the slot (130). The second material extends at least partially in the depression (120).

21 Claims, 11 Drawing Sheets

(56) References Cited

U.S. PATENT DOCUMENTS

| | | | | |
|---|---|---|---|---|
| 7,047,591 | B2 * | 5/2006 | Hohlbein | A46B 5/02 15/143.1 |
| 7,143,462 | B2 * | 12/2006 | Hohlbein | A46B 9/026 15/106 |
| 7,458,125 | B2 | 12/2008 | Hohlbein et al. | |
| 7,725,980 | B2 | 6/2010 | Moskovich | |
| 8,046,864 | B2 * | 11/2011 | Baertschi | A46B 5/02 15/110 |
| 8,522,389 | B2 | 9/2013 | Kwon et al. | |
| 2007/0119010 | A1 | 5/2007 | Hohlbein et al. | |
| 2009/0188063 | A1 | 7/2009 | Baertschi et al. | |
| 2012/0222228 | A1 | 9/2012 | Natividad | |
| 2013/0305472 | A1 | 11/2013 | Hohlbein | |

FOREIGN PATENT DOCUMENTS

| | | |
|---|---|---|
| CN | 100479704 | 4/2009 |
| CN | 201256721 | 6/2009 |
| CN | 201365646 | 12/2009 |
| CN | 201499805 | 6/2010 |
| CN | 102113764 | 7/2011 |
| EP | 0 613 636 | 9/1994 |
| IN | 579-BOM-1997 | 10/2002 |
| IN | 379-BOM-1998 | 6/2003 |
| IN | 622/MUM/2005 | 4/2007 |
| WO | WO 02/078489 | 10/2002 |
| WO | WO 2004/060107 | 7/2004 |
| WO | WO 2006/125597 | 11/2006 |
| WO | WO 2011/075133 | 6/2011 |
| WO | WO2012105964 | 8/2012 |

* cited by examiner

ORAL CARE IMPLEMENT

CROSS-REFERENCE TO RELATED PATENT APPLICATIONS

This application is a U.S. national stage application under 35 U.S.C. §371 of PCT Application No. PCT/CN2013/073298, filed Mar. 28, 2013, the entirety of which is incorporated herein by reference.

FIELD OF THE INVENTION

The present invention relates generally to oral care implements, and more particularly to an oral care implement such as a toothbrush in one embodiment with unique handle construction.

BACKGROUND OF THE INVENTION

Modern oral care implements such as toothbrushes are often formed as composite structures constructed of at least two different materials which are configured to form a head for supporting tooth cleaning elements and a handle having a gripping portion for holding with a user's hand and a sometimes narrower neck portion supporting the head. A body formed of a base material, typically a rigid or semi-rigid type polymeric material (e.g. polypropylene and others), constitutes the main structure of the toothbrush handle. A second material, often an elastomeric (e.g. thermoplastic elastomer or TPE), is overlaid on various portions of the body for improved grip and ornamental appearance.

Toothbrushes are typically formed by injection molding. The body is first molded in a first operation from the base material, and then the second elastomeric material is overmolded onto body in a second operation to complete the toothbrush. Due to intricate applications and configurations of elastomers used in some toothbrush configurations, proper distribution of the fluidic elastomer to various surfaces on the base structure body in the second molding process presents a challenge to find the most cost-effective injection and distribution approach. In addition, it is further desirable to minimize the amount of base material used to fabricate the body for cost saving reasons.

An improved toothbrush construction and molding approach is therefore desired.

BRIEF SUMMARY OF THE INVENTION

An oral care implement such as a toothbrush according to one embodiment of the present invention includes an elongated body formed of a first material and including a head defining a distal end, a handle defining a proximal end, and a longitudinal axis extending between the proximal and distal ends. The handle comprises a front exposed surface, a rear exposed surface, a proximal gripping portion, and a distal neck portion supporting the head. A longitudinally elongated through slot is formed in the gripping portion of the handle. The slot extends transversely between the front and rear exposed surfaces of the handle, and further extends axially along the longitudinal axis. The slot has a greater length measured in a direction of the longitudinal axis than a width measured in a direction transverse to the longitudinal axis. A second material is disposed in the slot and extends transversely from the front exposed surface of the handle through the slot to the rear exposed surface of the handle; the second material being different than the first material in at least one characteristic. In certain embodiments, the at least one characteristic may be hardness or color. In one embodiment, the second material is a thermoplastic elastomer.

In another embodiment, a toothbrush according to the present disclosure includes an elongated body formed of a first material and including a head defining a distal end, a handle defining a proximal end, and a longitudinal axis extending between the proximal and distal ends. The handle comprises a front exposed surface, a rear exposed surface, a proximal gripping portion, and a distal neck portion supporting the head. A longitudinally elongated through slot is formed in the gripping portion of the handle. The slot extends transversely to the longitudinal axis and penetrates the front and rear exposed surfaces of the handle, and the slot further extends axially along the longitudinal axis. A longitudinally elongated depression is formed in the rear exposed surface of the handle and has a concave shape in transverse cross-section. A second material is disposed in the slot and filling the slot from the front exposed surface of the handle through the slot to a bottom of the depression; the second material being different than the first material in at least one characteristic.

In another embodiment, a toothbrush according to the present disclosure includes a head, a handle having a front exposed surface and a rear exposed surface, the elongated handle extending along a longitudinal axis, and a longitudinally elongated concave depression formed into the rear exposed surface of the handle. The handle includes a first component formed of a first material and a second component formed of a second material. A through-slot is formed in the first component that extends between a front exposed surface of the first component and a rear exposed surface of the first component. The second component extends through the through-slot so that a first surface of the second component forms a portion of the front exposed surface of the handle and a second surface of the second component forms a portion of the rear exposed surface of the handle, wherein the portion of the rear exposed surface of the handle that is formed by the second surface of the second component forms a floor of the longitudinally elongated concave depression. In one embodiment, the first component is a hard rigid or semi-rigid polymer and the second component is a softer thermoplastic elastomer by comparison.

In another embodiment, a toothbrush according to the present disclosure includes an elongated body formed of a first polymeric material and including a head defining a distal end, a handle defining a proximal end, and a longitudinal axis extending between the proximal and distal ends. The handle comprises a front exposed surface, a rear exposed surface, a proximal gripping portion, and a distal neck portion supporting the head. A longitudinally elongated depression is formed in the rear exposed surface of the handle and has a concave shape in transverse cross-section; the depression including a pair of opposing arcuately shaped sidewalls converging into a base wall formed of a second thermoplastic elastomeric material. The base wall of the depression is recessed below the rear exposed surface of the handle.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE INVENTION

Figure 1:
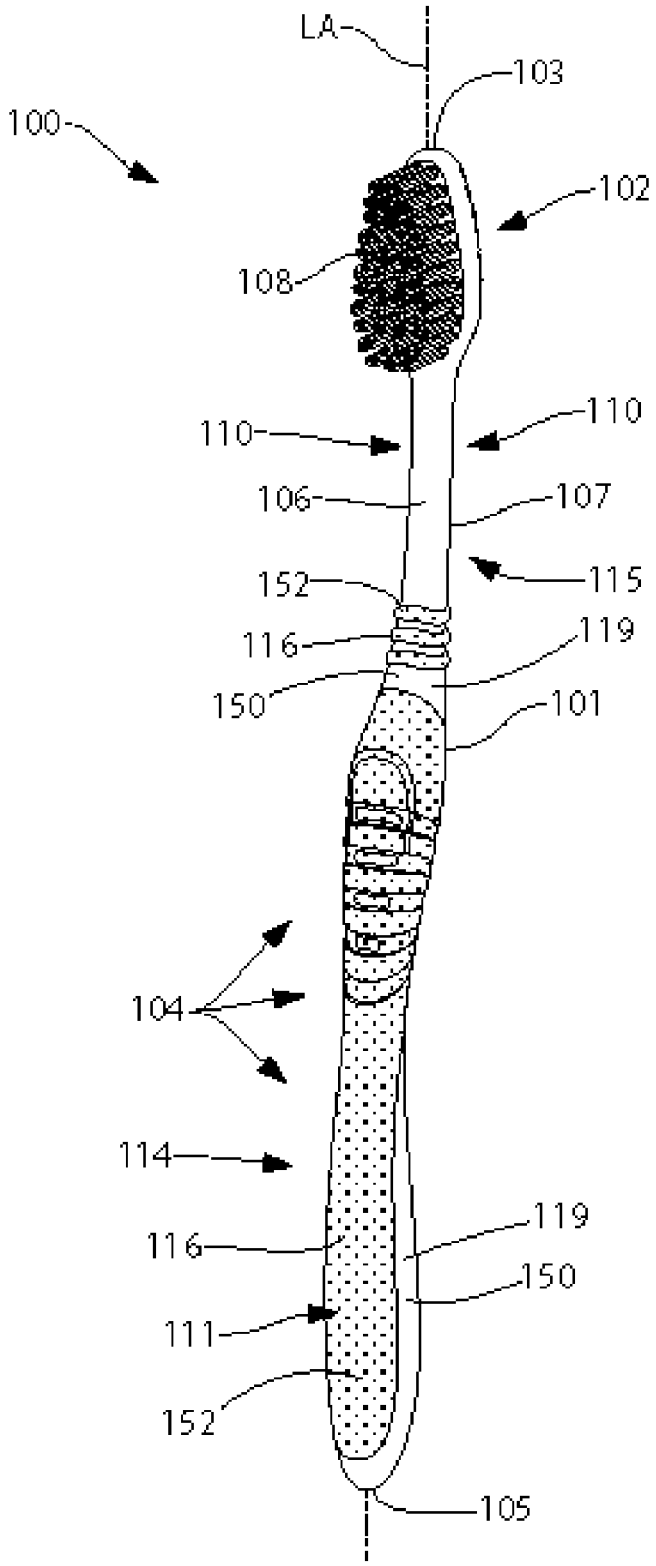
FIG. 1 is a front perspective view of a toothbrush according to one exemplary embodiment of the present invention showing an elastomeric material formed on the toothbrush body.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

FIGS. 1-5 depict one exemplary embodiment of an oral care implement in the form of a toothbrush 100. Toothbrush 100 includes an elongated body 101 including a head 102 defining a distal end 103, a handle 104 defining a proximal end 105, and a longitudinal axis LA extending between the proximal and distal ends. Toothbrush 100 has a front side 106, a rear side 107, and two opposing lateral sides 110. Toothbrush head 102 supports a plurality and variety of tooth cleaning elements 108 on the front side which are anchored in toothbrush head 102 by any suitable conventional attachment method used in the art.

The exact structure, pattern, orientation and material of the tooth cleaning elements 108 is not to be limiting of the present invention unless so specified in the claims. As used herein, the term "tooth cleaning elements" is used in a generic sense to refer to any structure that can be used to clean, polish or wipe the teeth and/or soft oral tissue (e.g. tongue, cheek, gums, etc.) through relative surface contact. Common examples of "tooth cleaning elements" include, without limitation, bristle tufts, filament bristles, fiber bristles, nylon bristles, spiral bristles, rubber bristles, elastomeric protrusions, flexible polymer protrusions, combinations thereof and/or structures containing such materials or combinations. Suitable elastomeric materials include any biocompatible resilient material suitable for uses in an oral hygiene apparatus. To provide optimum comfort as well as cleaning benefits, the elastomeric material of the tooth or soft tissue engaging elements has a hardness property in the range of A8 to A25 Shore hardness. One suitable elastomeric material is styrene-ethylene/butylene-styrene block copolymer (SEBS) manufactured by GLS Corporation. Nevertheless, SEBS material from other manufacturers or other materials within and outside the noted hardness range could be used.

The tooth cleaning elements 108 of the present invention can be connected to the head portion 102 in any manner known in the art. For example, staples/anchors, in-mold tufting (IMT) or anchor free tufting (AFT) could be used to mount the cleaning elements/tooth engaging elements. In AFT, a plate or membrane is secured to the brush head such as by ultrasonic welding. The bristles extend through the plate or membrane. The free ends of the bristles on one side of the plate or membrane perform the cleaning function. The ends of the bristles on the other side of the plate or membrane are melted together by heat to be anchored in place. Any suitable form of cleaning elements may be used in the broad practice of this invention. Alternatively, the bristles could be mounted to tuft blocks or sections by extending through suitable openings in the tuft blocks so that the base of the bristles is mounted within or below the tuft block.

The rear side of toothbrush head 102 may include soft oral tissue cleaning element(s) 109 having a variety of configurations which are made of an elastomeric material for cleaning the cheeks and tongue. In the exemplified embodiment, the soft oral tissue cleaning element(s) 109 comprises a plurality of isolated and separate ridges extending across the rear side of the toothbrush head 102 including some ridges that are arcuate in shape and others that are linear in shape. The invention is not to be limited by the exact configuration of the soft oral tissue cleaning element(s) 109 as illustrated in all embodiments. An example of an alternative suitable soft tissue cleanser that may be used with the present invention and positioned on the rear surface of the toothbrush head 102 is disclosed in U.S. Pat. No. 7,143,462, issued Dec. 5, 2006 to the assignee of the present application, the entirety of which is hereby incorporated by reference. In certain other embodiments, the soft tissue cleanser may include protuberances, which can take the form of elongated ridges, nubs, or combinations thereof. Of course, the invention is not to be so limited and in certain embodiments the oral care implement 100 may not include any soft tissue cleanser.

Body 101 forms the main structural component or substrate of the toothbrush 100 and may be made of any suitable material. In some representative embodiments, without limitation, body 101 may be made from a rigid or semi-rigid polymeric material used for toothbrush bodies. Suitable materials for the body 101 include polyethylene, polypropylene (PP), polyamide, polyester, cellulosics, SAN, acrylic, ABS or any other of the commonly known thermoplastics used in toothbrush manufacture. In one embodiment, the body 101 may be formed of polypropylene which forms a chemical bond with resilient thermoplastic elastomers when overmolded to retain the elastomer on the body. In one embodiment, polypropylene used for toothbrush body 101 may have a Shore A hardness of about and including 66-94. Any suitable color may be used for toothbrush body 101. In one embodiment, the body 101 is white.

In the exemplified embodiment, the toothbrush head 102 is formed integrally with the handle 104 as a single unitary structure using a molding, milling, machining or other suitable process. However, in other embodiments the handle 104 and the head 102 may be formed as separate components which are operably connected at a later stage of the manufacturing process by any suitable technique known in the art, including without limitation thermal or ultrasonic welding, a tight-fit assembly, a coupling sleeve, threaded engagement, adhesion, or fasteners.

Handle 104 includes a front exposed surface 111, a rear exposed surface 112, and opposing lateral side surfaces 113. Handle 104 defines a proximal gripping portion 114 extending longitudinally from proximal end 105 towards head 102 and a distal neck portion 115 supporting the head 102. Handle 104 is generally axially elongated and may have any suitable shape configured for grasping by a user with their fingers, thumb, and palm.

The handle 104 may be comprised of a first component 150 formed of a first material 119 and a second component 152 formed of a second material 116. The second material 116 may be different than the first material. In one embodiment, the first material 119 may be the same as the material used to construct body 101 of toothbrush 102 such as a hard rigid or semi-rigid plastic material as described elsewhere herein. The second material 116 in some embodiments may be a resilient material which is softer and more flexible than the first material by comparison. Accordingly, the Shore A hardness of the first material 119 of the first component 150 may be greater than the Shore A hardness of the second material 116 of the second component 152.

In certain embodiments, the second material 116 may be a rubber or thermoplastic elastomer (TPE) such as without limitation any of the GLS Thermoplastic Elastomers available from PolyOne Corporation of McHenry, Ill. suitable for toothbrushes. The TPE materials used may have a Shore A hardness from about and including 3 to 95. In other embodiments, the TPE materials used may have a Shore A hardness from about and including 13 to 50. In still other embodiments, the TPE materials used may have a Shore A hardness from about and including 25 to 40. The second material 116 may be provided in any desired color. In some embodiments, second material 116 is non-white in color.

In one embodiment, the second material 116 may be applied to certain portions of handle 104 by overmolding onto the first material 119 of the handle. Second material 116 may be applied to portions of the front exposed surface 111, rear exposed surface 112, and lateral side surfaces 113 of toothbrush handle 104 in any suitable pattern and configuration to improve grip and for aesthetic purposes. In particular, gripping portion 114 of handle 104 may include the second material 116 to improve grip particularly with wet hands.

Figure 2:
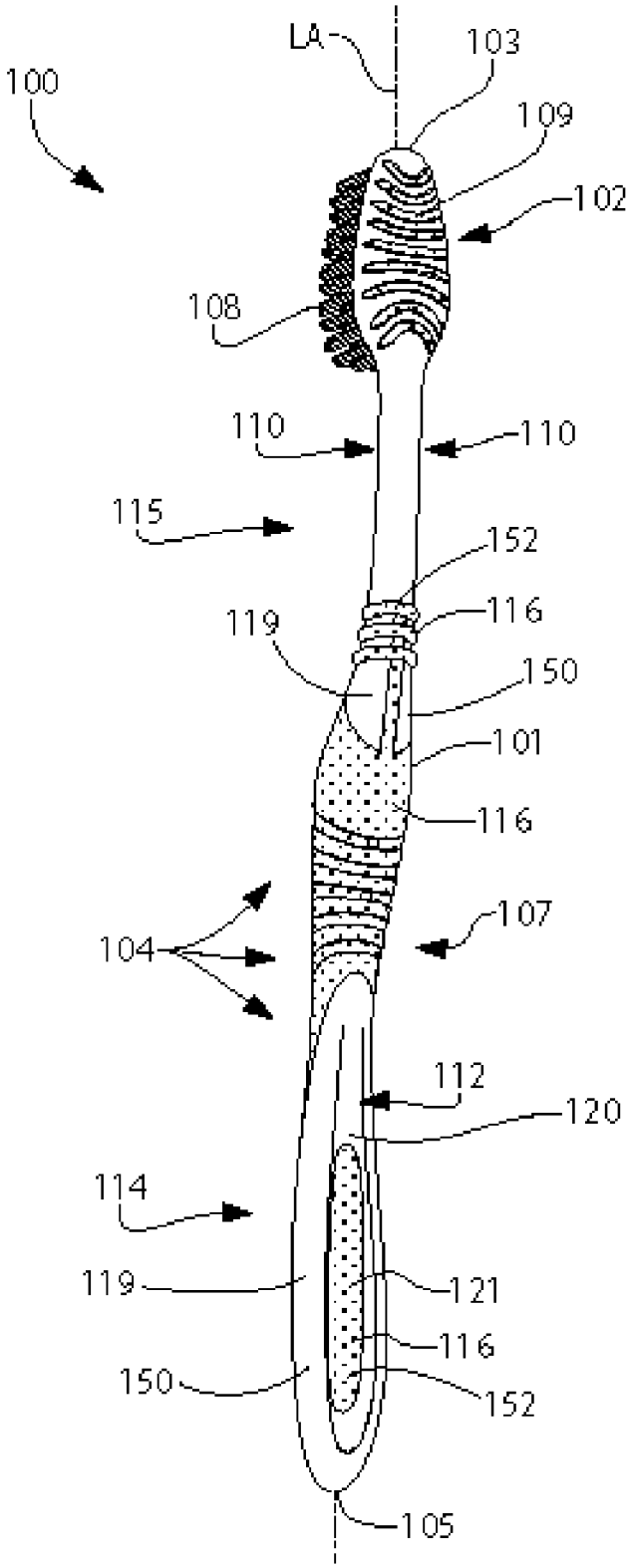
FIG. 2 is a rear perspective view thereof.
Figure 3:
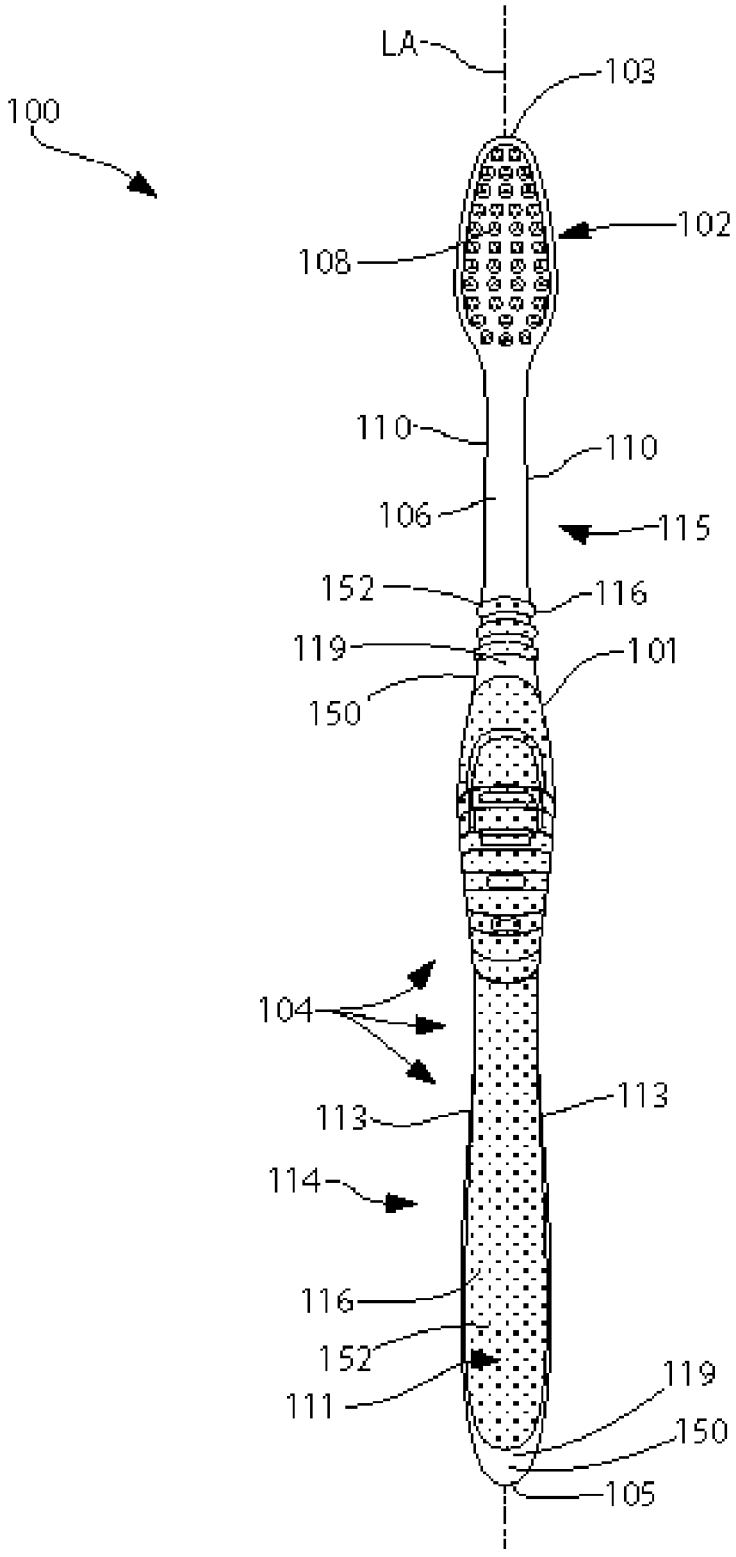
FIG. 3 is a front view thereof.
Figure 4:
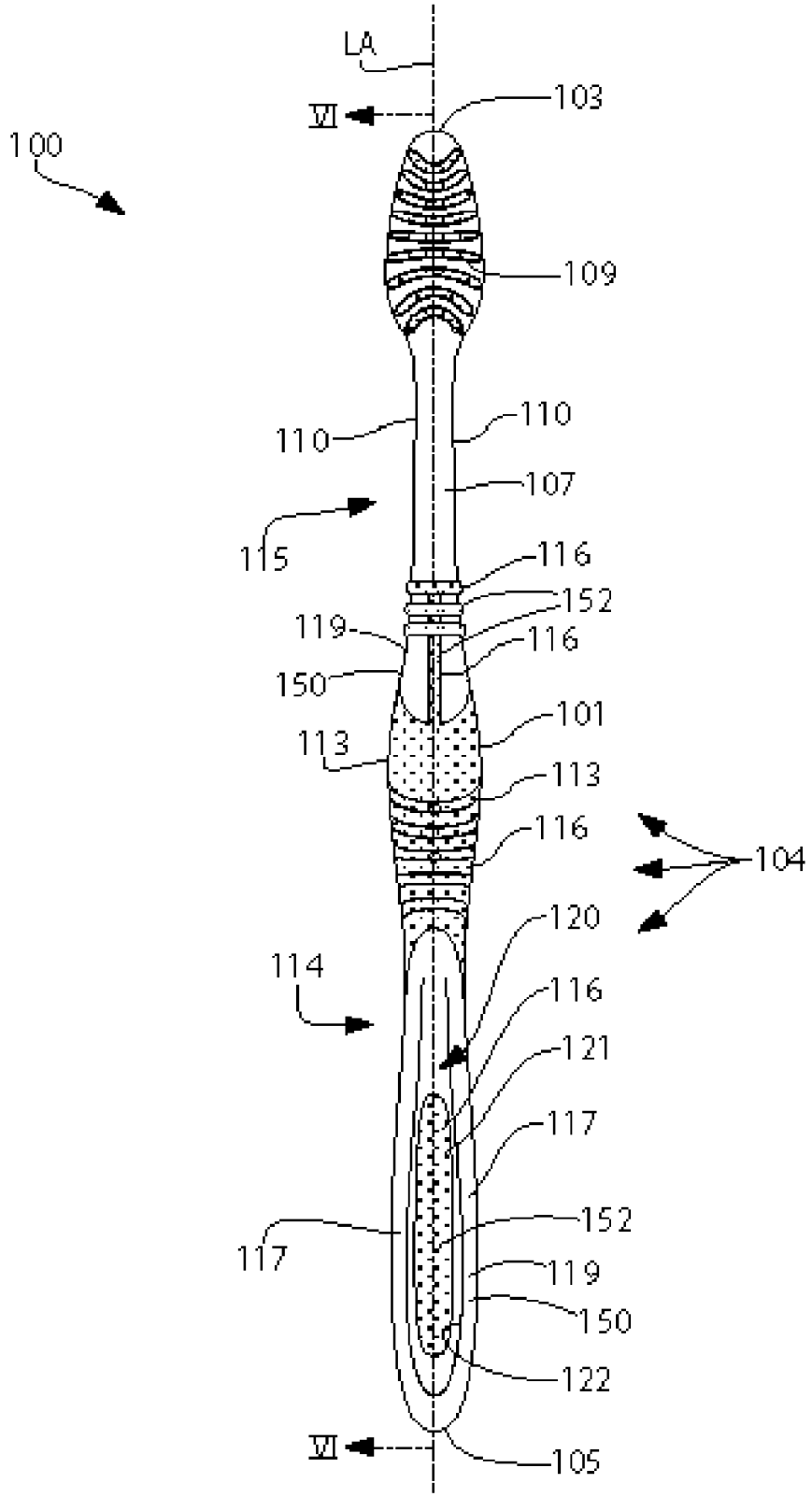
FIG. 4 is a rear view thereof.

According to one aspect of the invention, gripping portion of handle 104 includes a longitudinally elongated concave depression 120 as shown initially in FIGS. 2 and 4. In one embodiment, depression 120 is located in the rear exposed surface 112 of handle 104 as shown. This advantageously reduces the amount of material used to form body 101 thereby minimizing fabrication costs. In addition, depression 120 when located on rear exposed surface 112 of handle 104 further provides a stabilizer which ensures that the gripping portion 114 lies flat on a horizontal support surface such as a sink or table to keep toothbrush 100 oriented with the tooth cleaning elements 108 in an upright position when the user lies the toothbrush down. The longitudinally extending portions of rear exposed surface 112 adjacent depression 120 form opposing and laterally spaced apart rails 117 (see, e.g. FIGS. 4 and 8) which abuttingly contact the support surface.

In other possible embodiments, depression 120 may be located in front exposed surface 111 formed in the rear exposed surface of the handle and having a concave shape in transverse cross-section. This provides the same body material reduction benefits, and provides an indentation which some users may find a comfortable place for their fingers when gripping the toothbrush handle 104.

Referring to FIGS. 2, 4, and 6-8, elongated depression 120 originates at a point T1 proximate to proximal end 105 of toothbrush handle 104 and extends axially towards distal end 103 at head 102. In one embodiment, depression 120 terminates at a point T2 located between proximal end 105 and neck portion 115 of handle 104. In certain embodiments, depression 120 has a length L1 which is at least 15% of the overall longitudinal length of toothbrush 100 measured from proximal end 105 to distal end 103. In some embodiments, length L1 is between about and including 20% to 30% percent of the overall longitudinal length of toothbrush 100. For example, in one embodiment, toothbrush 100 has an overall length of about 7.5 inches and depression 120 has an axial length L1 of about 2.0 inches, or about 26.7%. Other suitable lengths L1 may be provided.

With continuing reference to the foregoing figures, depression 120 includes a floor or base wall 121 and two opposing arcuately curved lateral sidewalls 122 which converge at the base wall. Base wall 121 is recessed within the depression of the outermost part of rear exposed surface 112 which formed rails 117. In one embodiment, base wall 121 may be formed of the second elastomeric material 116 and sidewalls 122 may be formed of the body 101 material. In another embodiment, the base wall 121 and sidewalls 122 may be formed of the polymeric material used for body 101. Depression 120 has a substantially concave shape in transverse cross-section (see, e.g. FIG. 8), and in some embodiments the depression may further have a generally concave shape in longitudinal cross-section (see, e.g. FIG. 7). Base wall 121 may have a slightly concave shape in transverse cross-section as shown in FIG. 8 or may be substantially planar.

Figure 8:
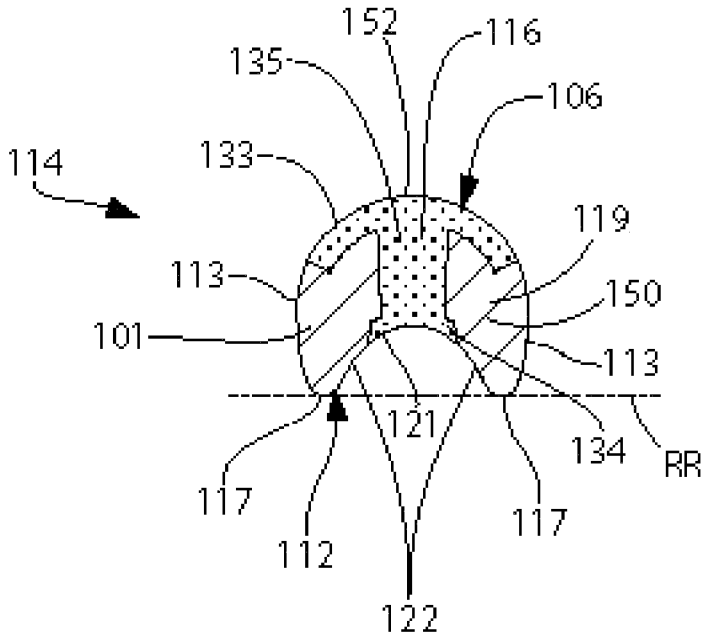
FIG. 8 is a transverse cross-sectional view thereof taken along lines VIII-VIII in FIG. 5.
Figure 9:
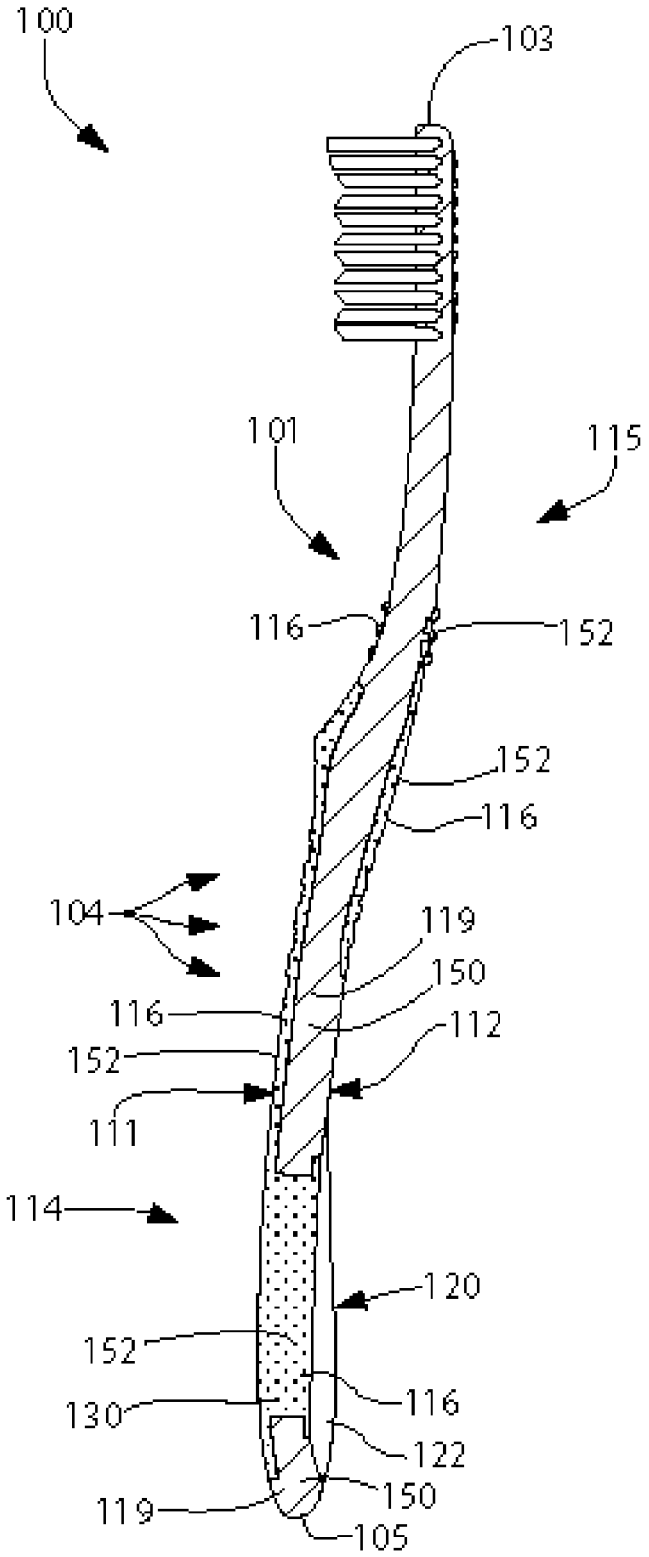
FIG. 9 is a cross-sectional side elevation view of the toothbrush similar to FIG. 6 but showing the elastomeric material in the through slot.

As shown in FIG. 8, the rear exposed surface 112 at the outermost part of each lateral sidewall 122 transitions from a concave arcuate shape in transverse cross-section within the depression 120 to a convexly shaped rear exposed surface 112 above the sidewalls which forms rails 117 described above for stabilizing the toothbrush 100 when rested on a flat surface so that it remains in an upright position.

Figure 6:
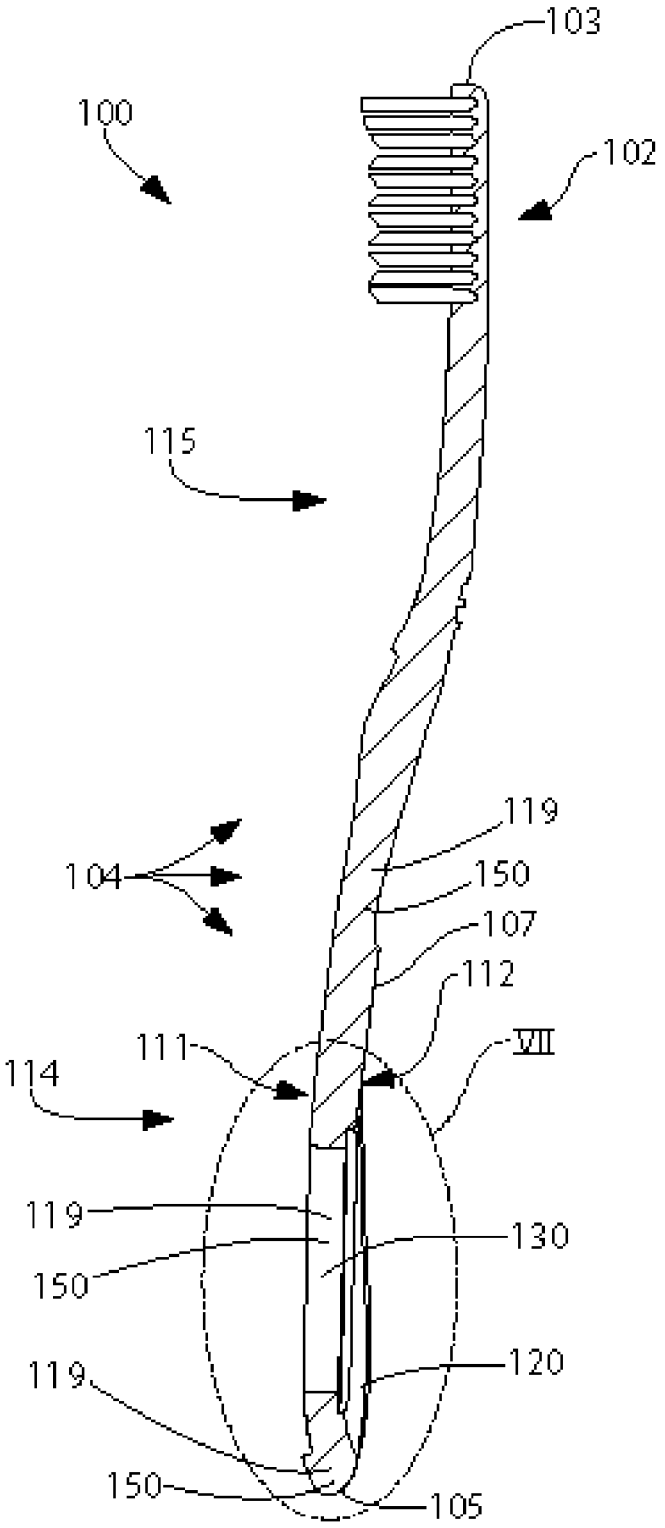
FIG. 6 is a longitudinal cross-sectional side elevation view thereof taken along lines VI-VI in FIG. 4 showing a through slot in the handle without the elastomeric material for clarity.
Figure 7:
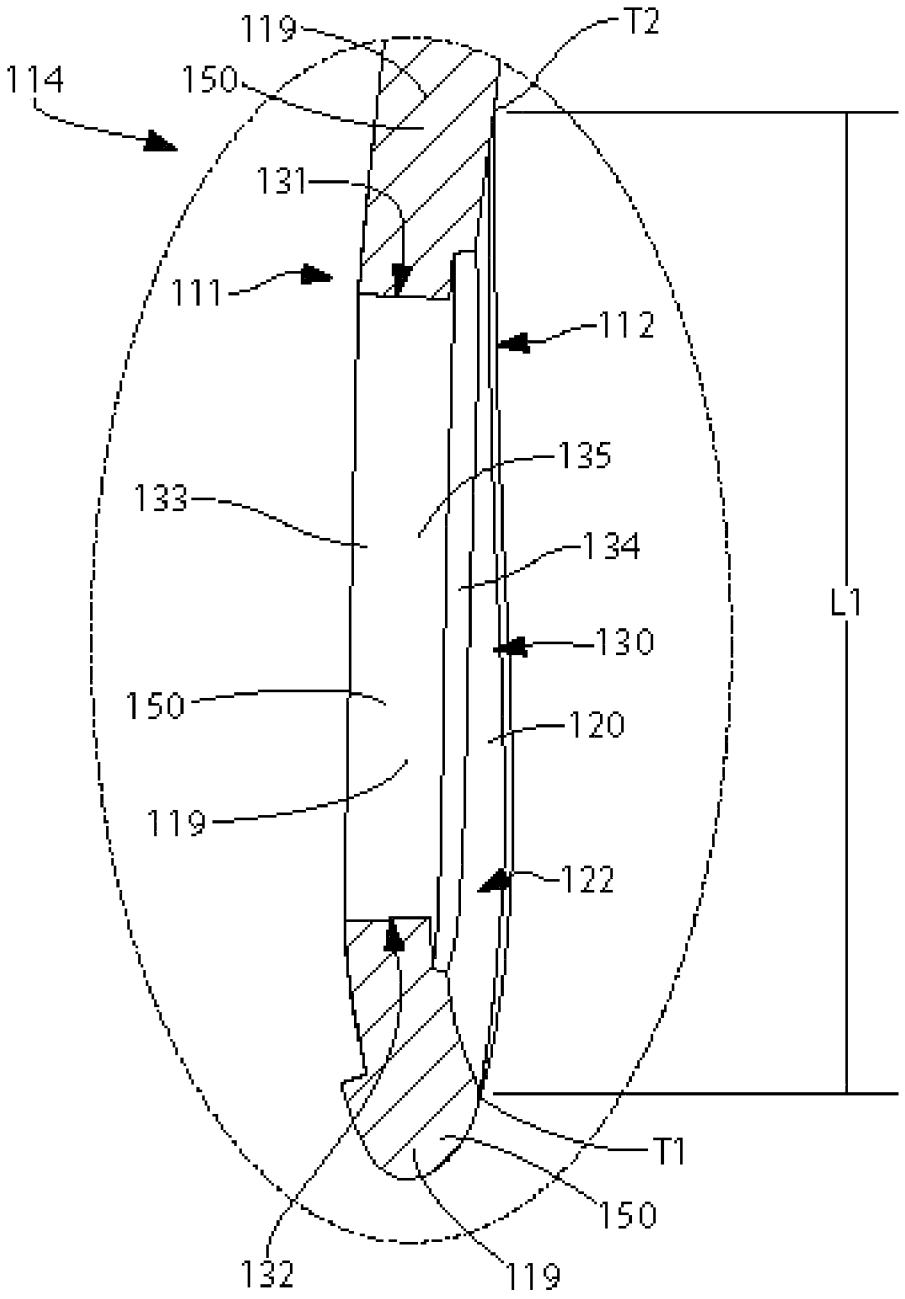
FIG. 7 is an enlarged view thereof but showing the elastomeric material.

According to another aspect of the invention, handle 104 includes a longitudinally-extending through slot 130 as shown in FIGS. 6-8. Slot 130 extends in a transverse direction completely through handle 104 between front exposed surface 111 and rear exposed surface 112, and in a longitudinal direction from an end wall 131 to end wall 132 in gripping portion 114 of the handle. More particularly, in certain embodiments, the through-slot 130 is formed in the first component 150 and extends between a front exposed surface of the first component 150 and a rear exposed surface of the first component 150.

Slot 130 forms a receptacle for receiving and holding the second material 116 of the second component 152 as shown in FIGS. 6-9. The second material 116 forms a monolithic unitary structure of the second component 152 that extends transversely through the through slot 130 to form an exposed upper gripping surface of the second material on the front exposed surface 111 of the handle 104 and an exposed lower gripping surface on the rear exposed surface 112 in the depression 120. Accordingly, the second component 152 extends through the through-slot so that a first surface of the second component forms a portion of the front exposed surface 111 of the handle 104 and a second surface of the second component forms a portion of the rear exposed surface 112 of the handle. The portion of the rear exposed surface 112 of the handle 104 that is formed by the second surface of the second component 152 forms a floor or base wall 121 of the longitudinally elongated concave depression 120.

Slot 130 includes an upper portion 133, lower portion 134, and a waist or middle portion 135. In certain embodiments, as best shown in FIG. 8, middle portion 135 is narrower than the lower portion 134 of the slot, and may also be narrower than the upper portion 135 of the slot which extends laterally beyond the middle portion on the front exposed surface 111 of the toothbrush handle 104. The lower portion 134 of the slot forms a well in the bottom of depression 120 which when filled with the second material 116 in turn forms the floor or base wall 121 (see, e.g. FIGS. 4 and 10).

Figure 10:
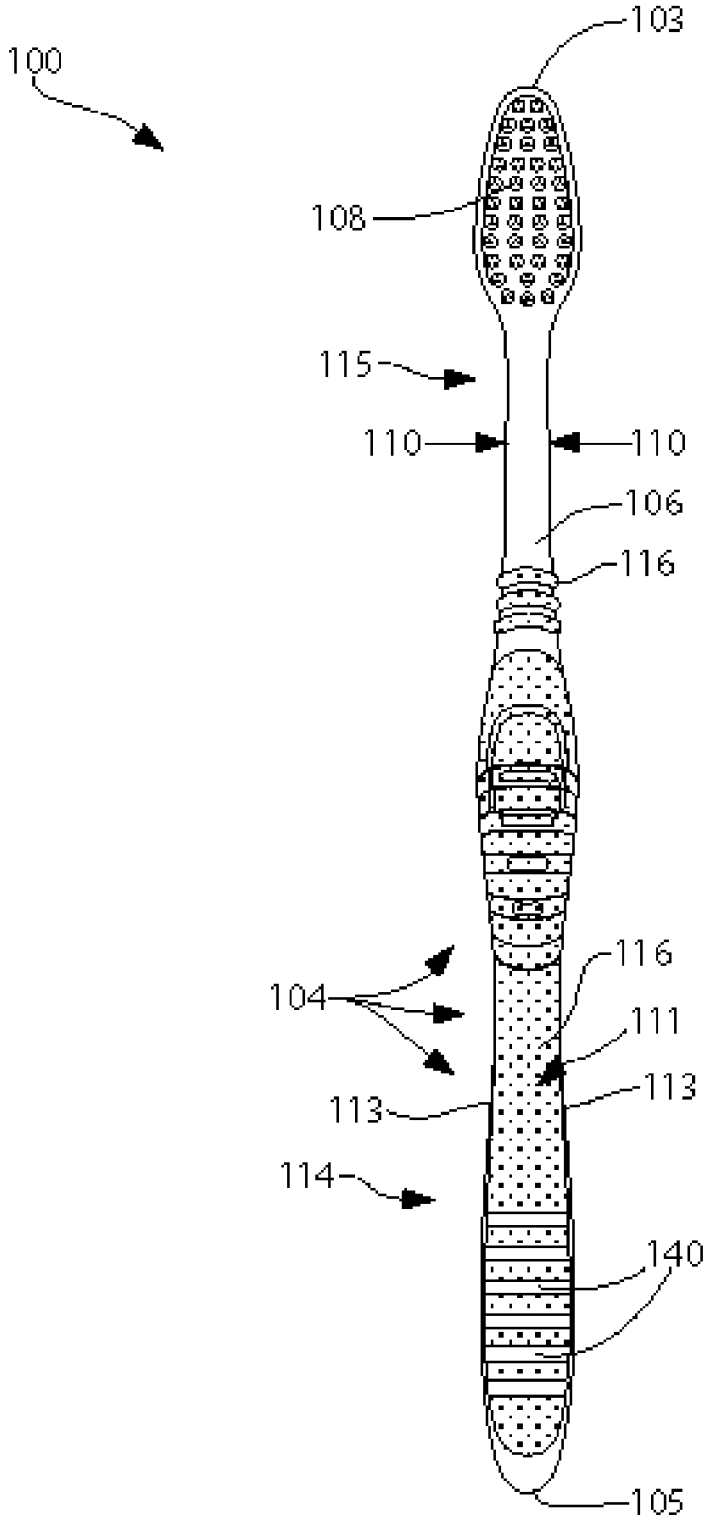
FIG. 10 is a front view of an alternative embodiment of the toothbrush.

When overmolded onto the handle 104, the upper portion 133 of slot 130 is filled with the second material 116 which will extend laterally beyond the middle portion 135 of the slot as shown in FIG. 10. When the overmolding process is completed, the second material 116 will have a resulting "I" shaped configuration in transverse cross-section as shown in FIG. 8 that locks the second material into place on the handle 104. In instances where polymeric materials are used as the first material 119 of the first component 150 of handle 104 that may not form a chemical mutual bond with the second material 116 selected during the overmolding process, the "I" shaped configuration of the second material 116 advantageously helps resists physical dislodgement of the second material from the toothbrush handle 104. In some possible embodiments contemplated in which a resilient material is not used as the second material 116, the toothbrush body 101 material and the second material may both be rigid or semi-rigid polymeric materials which do not form a mutual chemical bond since the locking "I" shaped configuration of the second material in slot 130 prevent dislodgement from the body 101 of the toothbrush.

An additional advantage of invention is that the through slot 130 allows the second material 116 disposed both in the slot and on the front exposed surface 111 of toothbrush handle gripping portion 114 to be molded in a single shot. In some embodiments, the second material 116 forms the base 121 of depression 120 as already described herein.

Yet an additional advantage of the invention is that the second material 116 extending completely through the through slot 130 provides additional transverse flexibility and comfort to the gripping portion 114 of handle 104.

Figure 11:
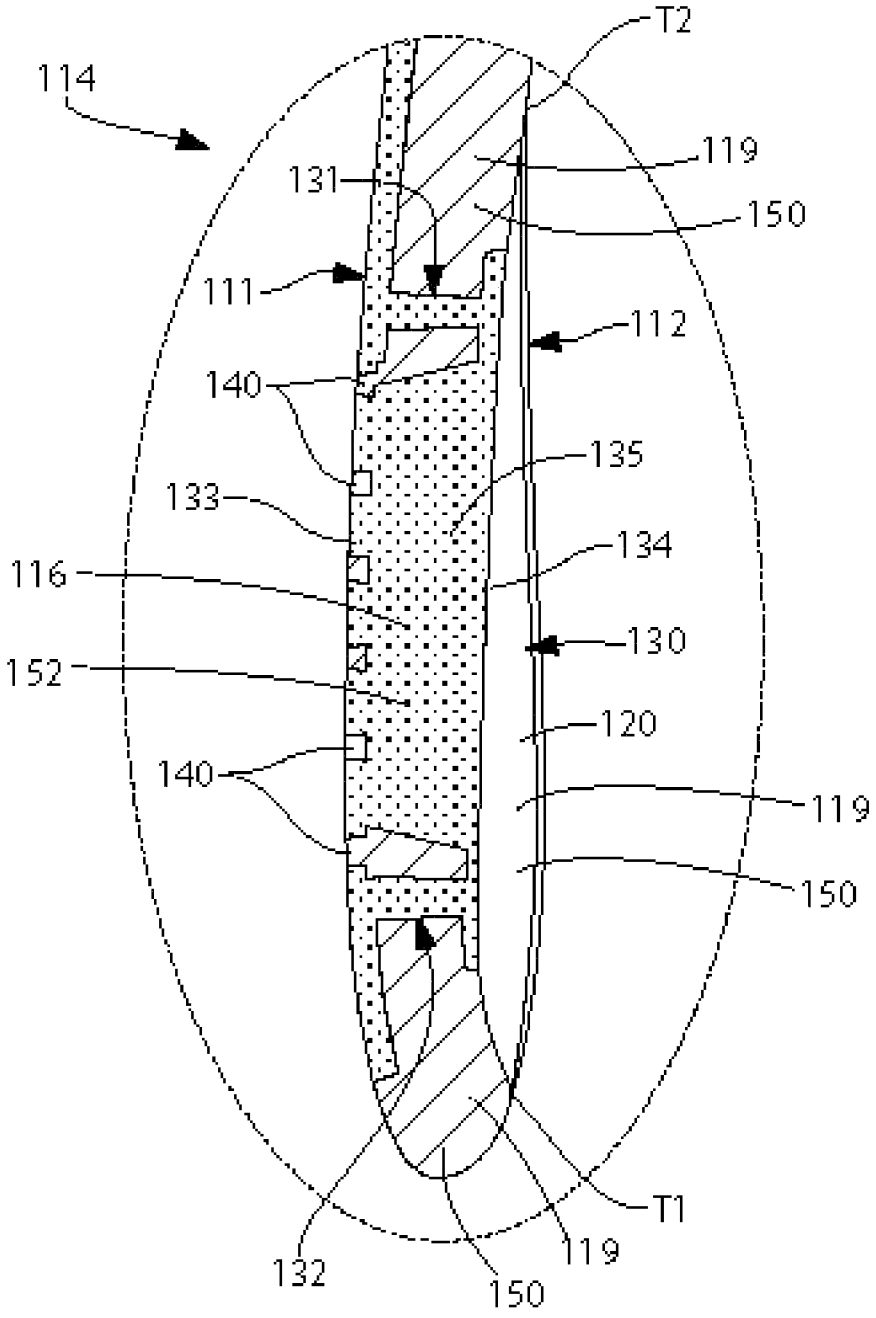
FIG. 11 is an enlarged longitudinal cross-sectional side elevation view of the toothbrush similar to FIG. 7 but showing the alternative embodiment of FIG. 10.

FIGS. 10 and 11 show an alternative embodiment of toothbrush 100 in which the upper portion 133 of the slot 130 is interrupted by a plurality, of spaced apart ornamental features 140 supported by the toothbrush body 101, which may be formed of the same rigid or semi-rigid polymeric material used for body. The ornamental features 140 may have any configuration. In the embodiment shown, the ornamental features 140 are comprised of a plurality of longitudinally spaced apart bars which span over the slot 130 with the interstitial spaces between the bars being filled by the second material 116 (see FIG. 10). The bars are shown in the enlarged longitudinal cross-section of FIG. 11 showing slot 130 without the second material 116 present for clarity. The ends of the bars are connected to the toothbrush body 101 adjacent the slot 130 for support before the overmolding process which injects the second material 116 into slot 130 which helps support the bars once solidified. In other possible, but non-limiting examples, the ornamental features 140 may be in the form of a combination of alphanumeric characters which may represent a brand or manufacturer name.

Figure 5:
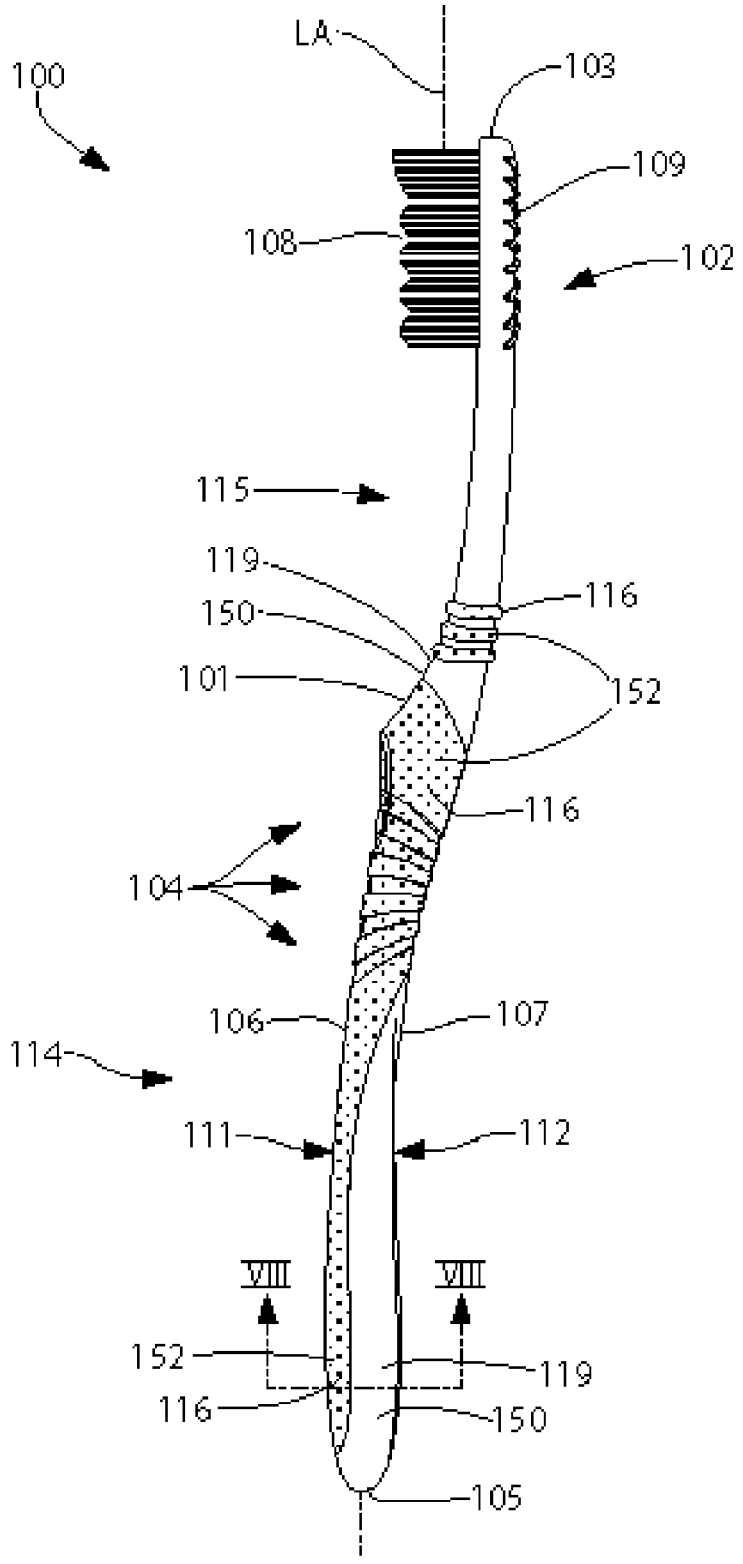
FIG. 5 is a side elevation view thereof.

Referring to FIGS. 5 and 8 concurrently, the depression 120 reduces the overall amount of material that would normally be required to form the handle 104 of the toothbrush. Thus, in certain embodiments, the depression 120 is designed to provide substantial materials savings. In one such embodiment, the handle 104 and depression 120 are sized so that, at an axial position along the handle 104, the handle comprises a first transverse cross-sectional area while the depression comprises a second traverse cross-sectional area, wherein the second traverse cross-sectional area is defined/bounded by that portion of the rear exposed surface of the handle 104 that defines the depression 120 and a reference plane R-R that intersects apexes of the sidewalls 122. In one embodiment, the depth and shape of depression 120 is selected so that the second transverse cross-sectional area is at least 15% of the first transverse cross-sectional area. In another embodiment, the second transverse cross-sectional area is between 15% to 50% of the first transverse cross-sectional area. In yet another embodiment, the second transverse cross-sectional area is between 20% to 40% of the first transverse cross-sectional area. In a further embodiment, the second transverse cross-sectional area is between 25% to 40% of the first transverse cross-sectional area As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is clamed is:

1. A toothbrush comprising:

a head;

a handle having a front exposed surface and a rear exposed surface, the handle extending along a longitudinal axis;

a longitudinally elongated concave depression formed into the rear exposed surface of the handle;

the handle comprising a first component formed of a first material and a second component formed of a second material;

a through-slot formed in the first component that extends between a front surface of the first component and a rear surface of the first component; and the second component extending through the through-slot so that a first surface of the second component forms a portion of the front exposed surface of the handle and a second surface of the second component forms a portion of the rear exposed surface of the handle, wherein the portion of the rear exposed surface of the handle that is formed by the second surface of the second component forms a floor of the longitudinally elongated concave depression.

2. The toothbrush according to claim 1 wherein the first component comprises the head.

3. The toothbrush according to claim 1 wherein the first material is a hard material and the second material is an elastomeric material.

4. The toothbrush according to claim 1 wherein the through-slot is elongated so as to have a length measured in a direction of the longitudinal axis that is greater than a width measured in a direction transverse to the longitudinal axis.

5. The toothbrush according to claim 1 wherein the first component comprises a rear exposed surface that forms portions of the rear exposed surface of the handle that are sidewalls of the longitudinally elongated concave depression.

6. The toothbrush according to claim 1 wherein the second component is a monolithic unitary structure and first surface of the second component forms a front gripping surface of the handle.

7. The toothbrush according to claim 1 wherein the through-slot is a longitudinally elongated through-slot, the first component comprising a plurality of spaced-apart transverse struts that interrupt the longitudinally elongated through-slot.

8. The toothbrush according to claim 1 wherein the floor of the longitudinally elongated concave depression has an oblong configuration in rear plan view of the handle.

9. The toothbrush according to claim 1 wherein the handle comprises a first transverse cross-sectional area taken at an axial position, and wherein the elongated concave depression comprises a second traverse cross-sectional area taken at the axial position, the second traverse cross-sectional area bounded by a portion of the rear exposed surface that defines the elongated concave depression and a reference plane that intersects apexes of sidewalls of the elongated concave depression, and wherein the second transverse cross-sectional area is at least 15% of the first transverse cross-sectional area.

10. The toothbrush according to claim 1 wherein the second component comprises a pad portion forming the floor of the longitudinally elongated concave depression.

11. A toothbrush comprising:

an elongated body formed of a first material and extending along a longitudinal axis, the elongated body comprising a front surface and a rear surface;

a longitudinally elongated through slot formed in the elongated body, the slot extending transversely between the front and rear surfaces of the elongated body and axially along the longitudinal axis, wherein the slot has a greater length measured in a direction of the longitudinal axis than a width measured in a direction transverse to the longitudinal axis; and a second material disposed in the slot, the second material comprising an exposed first portion that covers at least a portion of the front surface of the elongated body and an exposed second portion that is recessed relative to the rear surface of the elongated body, the second material being different than the first material in at least one characteristic.

12. The toothbrush according to claim 11, wherein the elongated body and the second material collectively form a handle of the toothbrush, and further comprising a longitudinally elongated concave depression formed into the handle, the exposed second portion of the second material forming a floor of the longitudinally elongated concave depression.

13. The toothbrush according to claim 12, wherein the first material forms opposing lateral sidewalls of the longitudinally elongated concave depression that extend from the exposed second portion of the second material to the rear surface of the elongated body, the opposing lateral sidewalls being exposed.

14. The toothbrush according to claim 11 wherein the at least one characteristic is Shore A hardness.

15. The toothbrush according to claim 11 wherein the at least one characteristic is color.

16. The toothbrush according to claim 11, wherein the second material is continuous on the front surface of the elongated body and across the slot.

17. The toothbrush according to claim 11 wherein the slot includes a middle portion disposed between the front and rear surfaces of the elongated body that is narrower in longitudinal cross-section than an adjoining lower portion of the slot near the rear surface of the elongated body.

18. The toothbrush according to claim 11 wherein the slot at the front surface of the elongated body is interrupted by a plurality of spaced apart ornamental features formed of the first material, the second material being disposed between the ornamental features, the ornamental features having front surfaces that are exposed and rear surfaces that are covered by the second material.

19. The toothbrush according to claim 11 wherein the first material is polypropylene and the second material is a thermoplastic elastomer.

20. A toothbrush comprising:

an elongated body formed of a first material and extending along a longitudinal axis, the elongated body comprising a front surface and a rear surface;

a longitudinally elongated through slot formed in the elongated body, the slot extending transversely to the longitudinal axis and penetrating the front and rear surfaces of the elongated body, the slot further extending axially along the longitudinal axis;

a second material disposed in the slot, the elongated body and the second material collectively forming a handle of the toothbrush; and a longitudinally elongated concave depression formed into the handle, an exposed portion of the second material forming a floor of the longitudinally elongated concave depression.

21. The toothbrush of claim 20, wherein the exposed portion of the second material is recessed relative to the rear surface of the elongated body.

* * * * *